US012053664B2

(12) United States Patent
Williams

(10) Patent No.: US 12,053,664 B2
(45) Date of Patent: Aug. 6, 2024

(54) EXERCISE DEVICE

(71) Applicant: Ronald Williams, Draper, UT (US)

(72) Inventor: Ronald Williams, Draper, UT (US)

( * ) Notice: Subject to any disclaimer, the term of this patent is extended or adjusted under 35 U.S.C. 154(b) by 650 days.

(21) Appl. No.: 17/027,536

(22) Filed: Sep. 21, 2020

(65) Prior Publication Data

US 2021/0086022 A1 Mar. 25, 2021

Related U.S. Application Data

(60) Provisional application No. 62/903,556, filed on Sep. 20, 2019.

(51) Int. Cl.
*A63B 21/00* (2006.01)
*A63B 21/06* (2006.01)

(52) U.S. Cl.
CPC ..... *A63B 21/4045* (2015.10); *A63B 21/06* (2013.01); *A63B 21/151* (2013.01); *A63B 21/4035* (2015.10); *A63B 21/4039* (2015.10)

(58) Field of Classification Search
CPC ... A63B 21/0557; A63B 21/06; A63B 21/151; A63B 21/4035; A63B 21/4039; A63B 21/4045; A63B 71/0686; A63B 2208/0219; A63B 2209/00; A63B 2220/17; A63B 2220/803; A63B 2225/09; A63B 2225/093; A63B 2225/50
See application file for complete search history.

(56) References Cited

U.S. PATENT DOCUMENTS 3,589,720 A * 6/1971 Agamian ..... A63B 22/203 482/114
4,930,769 A * 6/1990 Nenoff ..... A63B 21/0622 482/142
5,224,909 A * 7/1993 Hamilton ..... A63B 23/03575 601/33
5,518,483 A * 5/1996 Oswald ..... A63B 21/012 482/130
6,196,954 B1 * 3/2001 Chen ..... A63B 22/203 D21/676
7,485,079 B2 * 2/2009 Brown ..... A63B 22/205 482/907
7,585,263 B2 * 9/2009 Brown ..... A63B 22/203 482/142
7,775,950 B2 * 8/2010 Campanaro ..... A63B 21/0622 482/130

(Continued)

*Primary Examiner* — Joshua Lee
(74) *Attorney, Agent, or Firm* — David R. Conklin; Kirton McConkie

(57) ABSTRACT

An exercise machine to strengthen abdominal muscles may include a first unit and a second unit. The first unit may be adjustably coupled to the second unit. Each of the first unit and the second unit may include a track, an end bridge adjustably coupled to the track towards a first end of the track, a handle disposed proximate an outer surface of the track and towards a second end of the track, a platform slidably coupled to the track and configured to slide along at least a portion of a length of the track between the end bridge and the handle, and a tensioning element. A first end of the tensioning element may be coupled to the end bridge and a second end of the tensioning element may be coupled to the platform. The platform may include a knee adapter configured to accommodate a knee of a user.

16 Claims, 15 Drawing Sheets

(56) References Cited

U.S. PATENT DOCUMENTS 7,780,585 B1 * 8/2010 Rivas ..... A63B 22/203 482/140
7,931,570 B2 * 4/2011 Hoffman ..... A63B 23/03533 482/129
7,938,763 B2 * 5/2011 Campanaro ..... A63B 21/0628 482/140
7,998,043 B2 * 8/2011 Zhou ..... A63B 22/001 482/139
8,814,763 B2 * 8/2014 Ho ..... A63B 22/205 482/142
9,022,909 B2 * 5/2015 Kermath ..... A63B 21/0428 482/133
9,028,375 B2 * 5/2015 Ho ..... A63B 23/0216 482/142
9,028,376 B2 * 5/2015 Ho ..... A63B 22/14 482/142
9,205,295 B2 * 12/2015 Williams ..... A63B 21/4045
9,265,986 B1 * 2/2016 Godak ..... A63B 23/03541
10,426,991 B2 * 10/2019 Barnett ..... A63B 21/0552
11,446,540 B2 * 9/2022 Lagree ..... A63B 22/203
11,465,011 B1 * 10/2022 Lagree ..... A63B 21/068
2004/0077468 A1 * 4/2004 Myles, Sr. ..... A63B 23/0222 482/140
2007/0149370 A1 * 6/2007 Brown ..... A63B 22/205 482/140
2008/0070766 A1 * 3/2008 Brown ..... A63B 23/03525 482/140
2009/0018000 A1 * 1/2009 Brown ..... A63B 21/068 482/140
2010/0227748 A1 * 9/2010 Campanaro ..... A63B 21/068 482/140
2012/0225759 A1 * 9/2012 Tsai ..... A63B 23/12 482/131
2012/0244998 A1 * 9/2012 Rao ..... A63B 21/4017 482/70
2013/0095981 A1 * 4/2013 Chung-Ting ..... A63B 22/205 482/66
2013/0130875 A1 * 5/2013 Chou ..... A63B 23/03525 482/139
2013/0337982 A1 * 12/2013 Williams ..... A63B 23/03525 482/122
2014/0011645 A1 * 1/2014 Johnson ..... A63B 23/03525 482/121
2014/0045662 A1 * 2/2014 Williams ..... A63B 23/1236 482/126
2017/0014667 A1 * 1/2017 Barnett ..... A63B 23/03525

* cited by examiner

EXERCISE DEVICE

RELATED APPLICATIONS

This application claims priority to U.S. Provisional Patent application Ser. No. 62/903,556 filed Sep. 20, 2019, which is incorporated herein in its entirety.

TECHNICAL FIELD

The present disclosure relates to exercise machines. The exercise machines may include various features to ensure proper biomechanical motion of a user thereby preventing injury and increasing efficiency in muscular development.

BACKGROUND

Weight training may be performed using an exercise machine. Unlike free-weights, the exercise machine may be designed to limit biomechanical motion of a portion of a body of a user to one or two dimensions. In this way, the exercise machine may focus the resistance and efforts of the user to an isolated muscle or group of muscles.

Exercise machines may use gravity, friction, tension, compression, and/or hydraulic forces to provide isolated resistance to the user. Exercise machines may further provide optimized biomechanical movement and resistance for the body by incorporating various combinations of cables, cams, springs, elastomeric bands, hydraulic cylinders, levers, and pulleys into designs of the exercise machines. Exercise machines may thus be specifically designed to provide exact, repeatable biomechanical motions that are calculated to optimize desired muscular development. In theory, any user that performs weight training on an exercise machine will achieve particular muscular development for which the exercise machine was specifically designed.

Despite the general benefits of exercise machines, currently available devices have a number of shortcomings that result in less effective muscular development and potential joint and muscular injury to the user. For example, some exercise machines fail to consider and provide correct anatomical joint motion for the user. Some machines further fail to consider the structural anatomy of the targeted muscle group to optimally contract and extend the muscles for maximum efficiency and development. Thus, while exercise machines for developing the skeletal muscles are available, challenges still exist. Accordingly, there is a need in the art for an improved exercise machine that overcomes the current challenges.

BRIEF SUMMARY OF THE INVENTION

The present disclosure relates to an exercise machine that may be used to strengthen abdominal muscles of a user. In some embodiments, the exercise machine may facilitate strengthening of the abdominal muscles of the user in a similar manner to running or sprinting. However, the exercise machine may reduce a risk of injuries that may occur during running or sprinting, such as pulling a hamstring or another muscle of the user.

In some instances, the exercise machine may be laid on the floor with handles and knee adapters in an upward orientation. The user may grasp the handles and kneel on the exercise machine, placing his or her knees in the knee adapters, such that user's weight is supported on their hands and knees. In some instances, the user alternatively supports his or her forearms on an elevated platform while grasping vertically oriented handles, such that the user's weight is supported on their forearms and knees. The user may then engage in a motion similar to running, alternating between pulling the knee of the user's left leg toward the core of the user's body, and pulling the knee of the user's right leg toward core of the user's body. As the left knee and leg is pulled toward the core, one or more first abdominal muscles may contract, and as the right knee and leg is pulled toward the core, one or more second abdominal muscles opposite the first abdominal muscles may contract. Thus, the abdominal muscles of the user may be alternately strengthened. As the user pulls the left leg towards the core, the user may simultaneously flex left arm muscles. Similarly, as the user pulls the right leg toward the core, the user may simultaneously flex right arm muscles. Thus, the exercise machine may facilitate rotation of shoulders of the user as in running, which may also strengthen the abdominal muscles of the user. In some instances, the upper body of the user may be stabilized and supported in such a way that shoulder rotation is minimized during use of the exercise machine.

In some embodiments, the exercise machine may include a first unit and a second unit, which may be similar to each other. In some embodiments, the first unit may include an elongated track. In some embodiments, the track may include one or more of the following: a first end, a second end, a channel, an outer surface, an inner surface, and a lip.

In some embodiments, the first unit may include a handle. In some embodiments, the handle may include a gripping surface configured to accommodate a hand of the user. In some embodiments, the gripping surface may include a top surface to support a palm of the user. In some embodiments, the gripping surface may include an end surface to support a palm of the user. In some embodiments, the handle may include a central axis defined by a length of the gripping surface. In some embodiments, the central axis of the handle may be fixed in an orientation parallel to the track. In some embodiments, the central axis of the handle may be fixed in an orientation perpendicular to the track. In some embodiments, the first unit may include a gap between a bottom surface of the handle and the track whereby fingers of a hand of the user contact the bottom surface of the handle when the handle is gripped. In some embodiments, a position of the handle is adjustable to accommodate the physical attributes of a user. For example, in some embodiments a longitudinal position of the handle relative to a forearm support of the exercise machine may be adjusted.

In some embodiments, the first unit may include an end bridge, which may be adjustably coupled to the inner surface and outer surface towards the first end. In some embodiments, the first unit may include a platform, which may be slidably coupled to the track. In some embodiments, the platform may be configured to slide along at least a portion of a length of the track between the end bridge and the handle. In some embodiments, the platform may include a support surface or knee adapter configured to accommodate a knee of the user. For example, a knee adapter may include a cupped or concave surface. In some embodiments, the knee adapter may include cushioning material. In some embodiments, the platform may include a groove configured to receive the lip to prevent removal of the platform from the track. Alternatively, in some embodiments the track may comprise a rail, a plurality of rails, or a similar structure to which the platform is slidably, yet irremovably coupled.

In some embodiments, the first unit may include an elevated platform configured to support a user's forearm during use of the exercise machine. In some embodiments, the elevated platform further includes a pad or cushion to accommodate and support a user's elbow and/or forearm. In some instances, the elevated platform is positioned in proximity to a distal or second end of the first unit, such that the elevated platform is positioned generally opposite from the platform. In some embodiments, the elevated platform is supported by a stand. In some instances, a top end of the stand is coupled to the elevated platform and a bottom end of the stand is coupled to first unit. In some instances, the bottom end is coupled to a base, wherein the first unit is also coupled to the base. In some embodiments, a proximal or first end of the first unit is further coupled to the base, wherein the first unit is supported by the base, such that a gap is provided between a middle portion of the first unit and a surface on which the base is supported.

In some embodiments, the elevated platform of the first unit further comprises a handle configured to accommodate a user's grip while the user's elbow and/or forearm is supported by the elevated platform. In some instances, the handle is vertically oriented such that it is generally perpendicular to an orientation of the elevated platform. In some instances, the handles are coupled to the elevated platform by an extension, wherein the extension comprises a first end coupled to the elevated platform and/or the stand, and a second end coupled to the handle. In some instances, the first end of the extension is adjustably coupled to the elevated platform and/or stand such that a proximity of the handle to the elevated platform may be selectively adjusted to accommodate the physical attributes or anatomy of a user. In some instances, a desired position of the first end of the extension is maintained by a mechanical interference, such as by a set screw or a spring-loaded pin configured to intersect the extension and the elevated platform and/or the stand. In some embodiments, the stand or elevated platform further comprises a sleeve in which the extension is slidably housed.

In some embodiments, the first unit may include one or more tensioning elements. In some embodiments, the tensioning elements may include elastomeric bands. In some embodiments, first ends of each of the tensioning elements may be coupled to the end bridge and/or second ends of each of the tensioning elements may be coupled to the platform. In some embodiments, the end bridge may include a first set of notches and/or the platform may include a second set of notches. In some embodiments, the first ends of each of the tensioning elements may be coupled to the first set of notches and/or the second ends of each of the tensioning elements may be coupled to the second set of notches. In some embodiments, the tensioning elements may bias the platform towards and/or against the end bridge. In some embodiments, the tensioning elements may include a weight stack operably connected to the platform by one or more cables (or an equivalent element, such as a static band) and pulleys, such that the resistance of the platform may be adjusted by selecting a desired amount of weight from the weight stack.

In some embodiments, the track may include one or more holes, which may each be configured to selectively receive a pin of the end bridge to provide a fixed position for the end bridge on the track. In some embodiments, the fixed position of the end bridge may be slidably adjusted along the track to increase and decrease a distance between the end bridge and the handle. In some embodiments, the track may include one or more other holes, which may be configured to selectively receive a pin of an extension of the handle to provide a fixed position for the handle. In some embodiments, the extension of the handle may extend underneath at least a portion of the track.

In some embodiments, the first unit may include a middle bridge, which may be coupled to a middle portion of the track. In some embodiments, the platform may be configured to slide along at least a portion of the length of the track between the end bridge and the middle bridge. In some embodiments, the middle bridge may be coupled between the handle and the end bridge. In some embodiments, the middle bridge may be aligned with a portion of the handle closest to the first end. In some embodiments, the track does not include a middle bridge.

In some embodiments, the first unit may include a set of wheels or bearings, which may be coupled to the platform and/or in contact with a surface of the track, such as the channel, wherein the wheels or bearings are interposed between the platform and the track surface. In some embodiments, the first unit may include a measurement device. In some embodiments, the measurement device may be configured to count a number of times the platform moves away and/or toward the end bridge in a predetermined time period. In some embodiments, the measurement device may include a timer. In some embodiments, the measurement device may be configured to count a time it takes for the platform to move away and/or toward the end bridge a predetermined number of times.

The second unit may include same or similar elements as the first unit. For example, the second unit may include one or more of the following: an elongated track, a handle, an end bridge, a platform, an elevated platform, a stand, a base, an extension, one or more tensioning elements, a middle bridge, a set of wheels or bearings, and a measurement device. In some embodiments, the first unit may be coupled to the second unit. In some embodiments, the first unit may be adjustably coupled to the second unit. In some embodiments, the first and second units are coupled to a base. In some embodiments, the first and second units are adjustably coupled to a base.

In further detail, in some embodiments, the first unit may be adjustably coupled to the second unit such that a distance between the first unit and the second unit is adjustable, which may allow accommodation of a particular hip width of the user. Additionally or alternatively, in some embodiments, the first unit may be adjustably coupled to the second unit such that an angle between the first and second units is adjustable. In some embodiments, the first handle may be adjustably coupled to the second handle between the first and second tracks via any suitable mechanism, such as, for example, a pin mechanism. In some embodiments, each of the first and second units may be inclined with respect to a horizontal axis, for increased difficulty and muscle building.

DESCRIPTION OF THE DRAWINGS

It will be appreciated by those of ordinary skill in the art that the various drawings are for illustrative purposes only. The nature of the present invention, as well as other embodiments of the present invention, may be more clearly understood by reference to the following detailed description of the invention, to the appended claims, and to the several drawings.

DETAILED DESCRIPTION OF THE INVENTION

Some embodiments in accordance with the present disclosure provide an exercise machine that is safe for use. In some embodiments, the exercise machine may facilitate strengthening of the abdominal muscles of the user by mimicking motions of running or sprinting. However, the exercise machine may reduce a risk of injuries that may occur during running or sprinting, such as pulling a hamstring or another muscle of the user.

In some embodiments, the exercise machine may provide resistance or workload that is consistent, gradual, and progressive, thereby allowing the body of the user to adapt as the body moves through a range of motion. The gradual increase of tension may reduce jerky and ballistic movements that may result in injury. Also, the resistance provided by the exercise machine may be applied equally and independently to both sides of the body. As such, each side of the body may be required to carry its own workload, thus increasing an effectiveness of a workout and muscle development.

In some embodiments, friction may be reduced in each movement of the exercise machine. Thus, in some embodiments, the exercise machine may provide the user with smooth and comfortable transitions in the movements of the exercise machine. Further, the exercise machine may include a simple construction and layout that is easily and readily understood by the user. Thus, the user may easily and accurately perform exercise movements on the machine.

Figure 1A:
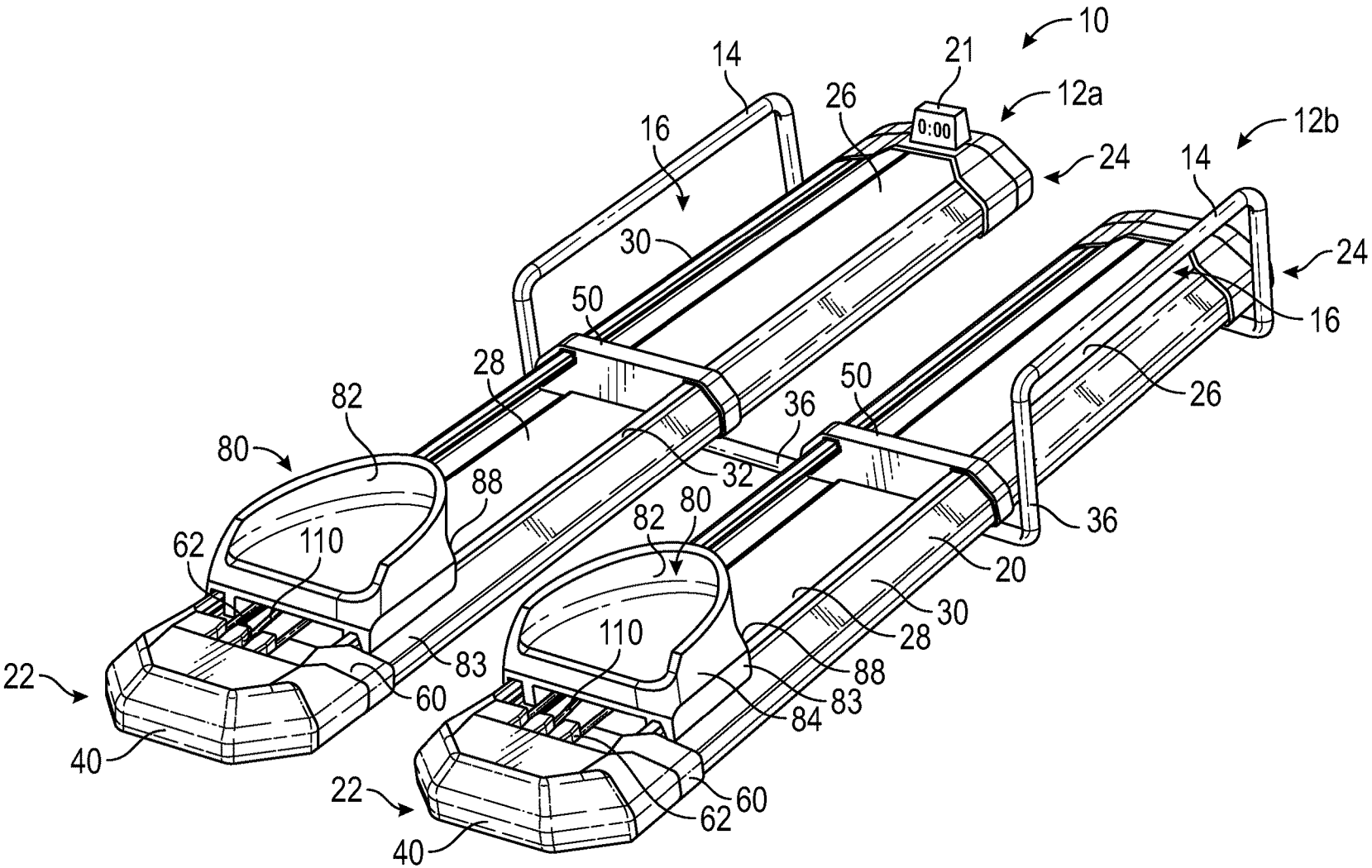
FIG. 1A is a perspective view of an example exercise machine.
Figure 1B:
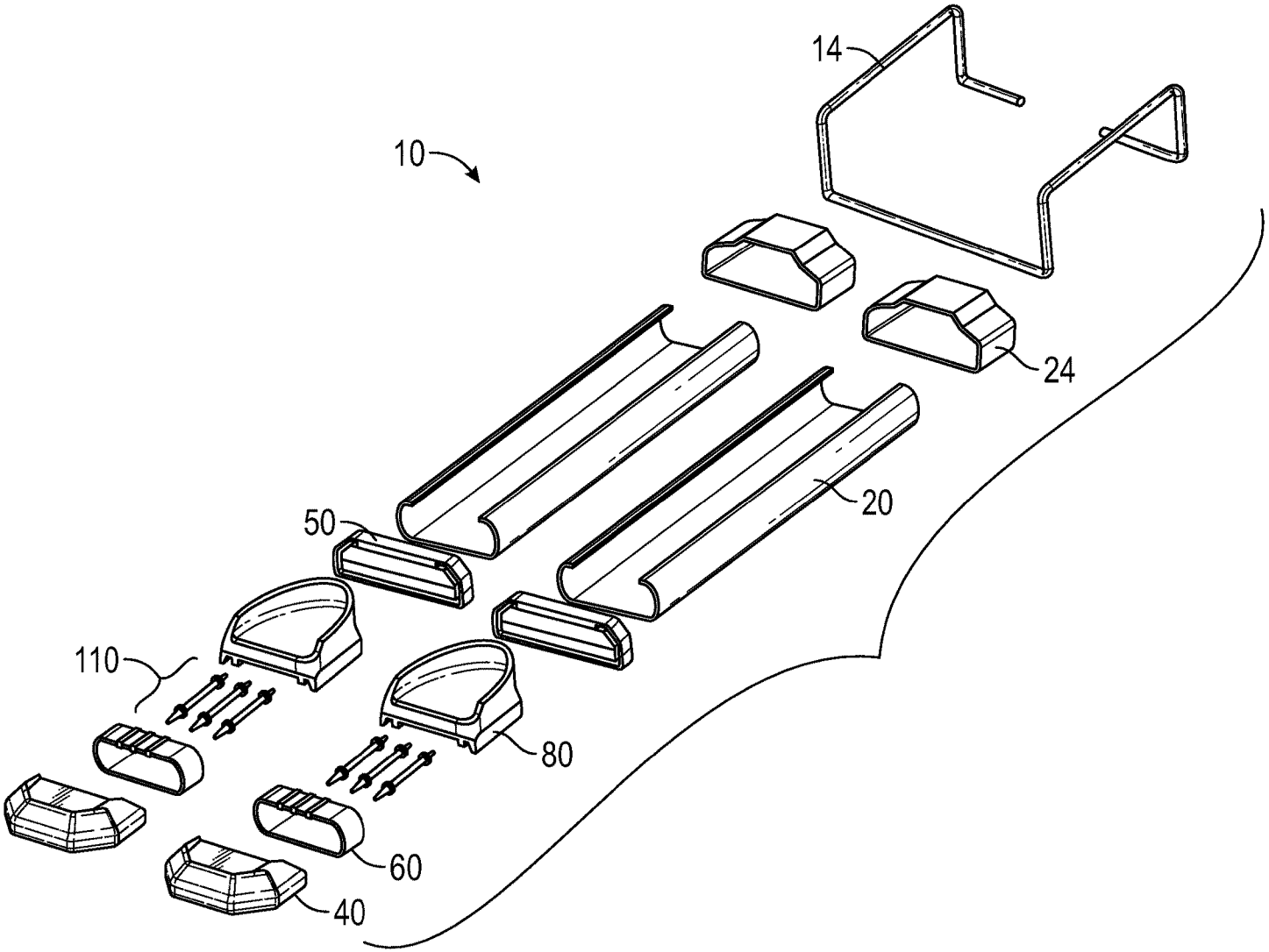
FIG. 1B is an exploded view of the example exercise machine of FIG. 1A, according to some embodiments.
Figure 2:
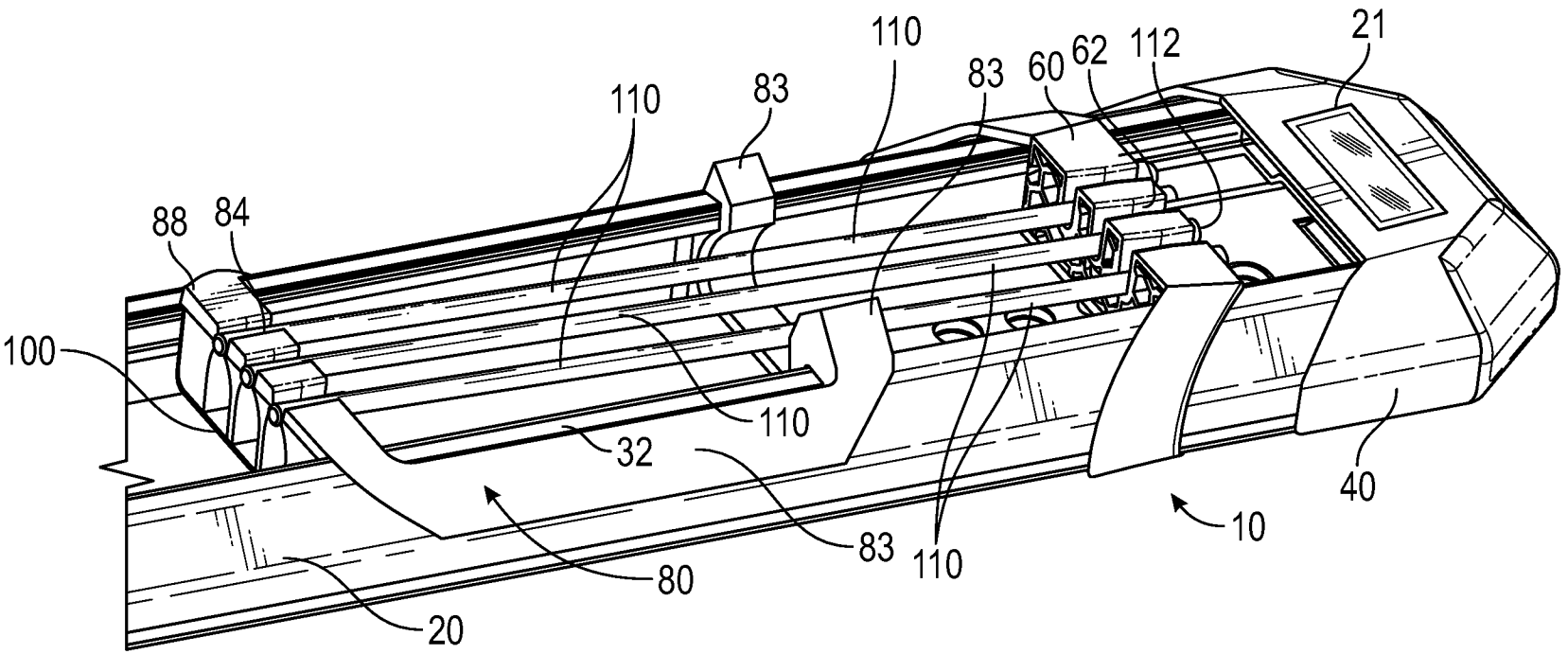
FIG. 2 is a perspective view of a portion of the exercise machine of FIG. 1 with a knee adapter removed, according to some embodiments.

Referring now to FIGS. 1A, 1B and 2, an exercise machine 10 is illustrated, according to some embodiments. In some embodiments, the exercise machine 10 may include a first unit 12*a* and a second unit 12*b* (which may be referred to in the present disclosure as "units 12"). In some embodiments, each of the units 12 may include a track 20. As used herein, the term "track" is understood to include any structure capable of supporting knee supports in a forward and backward translational movement, as disclosed herein. In some embodiments, each of the tracks 20 may include a first end 22, a second end 24, and a middle extending therebetween. In some embodiments, the tracks 20 may include any material or combination of materials that are suitable for use in an exercise machine. For example, in some embodiments, the tracks 20 may include an extruded metallic material, such as aluminum or steel. In some embodiments, the tracks 20 may include an injection molded polymer material, such as polycarbonate or polypropylene. In some embodiments, the tracks 20 may include a composite material.

In some embodiments, the tracks 20 may comprise any length, width, and/or height as may be desired. In some embodiments, each of the tracks 20 may include a U-shaped, cross-sectional profile forming a longitudinal channel 26 between the first and second ends 22 and 24. In some embodiments, the channel 26 may include an inner base surface 28 and sidewalls 30. In some embodiments, each of the sidewalls 30 may include a lip 32, which may reduce a width of an opening of channel 26. In some embodiments, the lip 32 may be configured to engage with, and thereby retain, a component within the channel 26, as discussed below. In some embodiments, tracks 20 comprise a rail, a plurality of rails, or a similar compatible structure, as may be known in the art.

In some embodiments, each of the first ends 22 may include an end cap 40. In some embodiments, the end caps 40 may be configured to close the first ends 22 of the channels 26. In some embodiments, the end caps 40 may include the same material as the tracks 20. In other embodiments, the end caps 40 may include a slip-resistant material configured to increase friction between each of the tracks 20 and a surface on which each of the tracks 20 is supported. For example, the end caps 40 may include a rubber polymer material, or may comprise a plastic polymer material having one or more surfaced coated with a rubber polymer material. In some embodiments, end caps 40 may comprise a closed or terminal end of tracks 20. Further, in some embodiments end caps 40 may comprise an obstruction to one or more surfaces of tracks 20.

In some embodiments, each of the first unit 12*a* and the second unit 12*b* may include a handle 14. It is understood that the handles 14 may be disposed at various locations and orientations with respect to the exercise machine 10. The handles 14 may also include various shapes and sizes that allow the user to grip the handles 14. In some instances, handles 14 comprise a plurality of separated handles that are each separately attached to one of first unit 12*a* or second unit 12*b*. In some instances, handles 14 comprise a singular or monolithic structure, wherein a portion of handles 14 bridges first and second units 12*a* and 12*b*, as shown.

As illustrated in FIGS. 1A and 1B, in some embodiments, each of the handles 14 may include a gripping surface configured to accommodate a hand of the user. In some embodiments, the gripping surface may include a top surface to support a palm of the user. In some embodiments, each of the handles 14 may include a central axis defined by a length of the gripping surface. In a preferred embodiment, the central axis of each of the handles 14 may be fixed in an orientation parallel to the track 20 closest to the corresponding handle 14. In some embodiments, the central axis of each of the handles 14 may be slightly angled, such as, for example, between 0 and 45 degrees, with respect to the track 20 closest to the corresponding handle 14. In some embodiments, each of the units 12 may include a gap 16 between a bottom surface of the handle 14 and the track 20 of the corresponding unit 12, whereby fingers of a hand of the user contact the bottom surface of the handle 14 when the handle 14 is gripped.

In some embodiments, each of the units 12 may include an end bridge 60. In some embodiments, the end bridge 60 may be adjustably coupled to the tracks 20, such as to an inner surface and an outer surface of a particular track 20 towards the first end 22 of the particular track 20 and/or proximate the end cap 40 of the particular track 20. In some embodiments, the end bridge 60 may be slidably mounted within, or in connection with the channel 26 of the particular track 20. In some embodiments, the end bridge 60 may include one or more notches 62. In some embodiments, the notches 62 may be configured to selectively receive one or more tensioning elements 110 (shown in FIG. 1B), as will be explained later in further detail.

In some embodiments, the end bridge 60 may include an outer surface that is shaped and configured to compatibly seat against the end cap 40. In some embodiments, the end bridge 60 may be configured to be selectively secured within the channel 26 at a particular location between the end cap 40 and the handle 14 corresponding to the unit 12 in which the end bridge 60 is disposed. In some embodiments, the end bridge 60 may include a set screw that may be tightened to prevent movement of the end bridge 60 within the channel 26. In some embodiments, the end bridge 60 may include other means for selectively securing its position within the channel 26, as is discussed below in connection with FIG. 4.

In some embodiments, each of the units 12 may include a platform 80. In some embodiments, the platform 80 of a particular unit 12 may be configured to slide along at least a portion of a length of the track 20 of the particular unit 12 between the end bridge 60 and end cap 40. In some embodiments, platform 80 of a particular unit 12 is configured to slide along at least a portion of a length of the track 20 of the particular unit 12 between the end bridge 60 and a proximal most end of the handle 14 of the particular unit. In some embodiments, the platform 80 of the particular unit may include a groove configured to receive the lip 32 of the track 20 of the particular unit to prevent removal of the platform 80 from the track 20. In some embodiments, platform 80 is configured to slidably, yet irremovably couple to a rail, a plurality of rails, or a similar structure of the track 20. In some embodiments, each of the platforms 80 may include a support surface or knee adapter 82 configured to accommodate a knee of the user. In some embodiments, knee adapter may comprise a cupped or concave surface. In some embodiments, knee adapter 82 comprises a cushion material.

In some embodiments, at least a portion of each of the knee adapters 78 may be positioned above the channels 26 and may be configured to support a knee of the user when the user is using the exercise machine 10. For example, a first platform 80 may include a first knee adapter 78 configured to accommodate a first knee of the user, and a second platform 80 may include a second knee adapter 78 configured to accommodate a second knee of the user. In some embodiments, a particular knee adapter 78 may include a pad. The platform 80 and the knee adapter 78 may include any suitable material or combination of materials disclosed in the present disclosure. In some embodiments, the platform 80 and knee adapter 78 may include a rigid or semi-rigid material that is capable of supporting the weight of the user during use of the exercise machine 10. In some embodiments, knee adapters 78 comprise an ergonomic surface configured to comfortably receive and support the user's knee throughout the exercise movement. In some instances, knee adapters 78 may further be configured to contact and support a portion of the user's shin.

In some embodiments, each of the units 12 may include a middle bridge 50, which may prevent the platform 80 of the corresponding unit 12 from sliding beyond a proximal most end of the handles 14, which may prevent injury and encourage proper technique. In some embodiments, the middle bridge 50 may be secured within the channel 26 between the first and second ends 22 and 24 at a desired location. In some instances, middle bridge 50 is secured within the channel 26 between the first and second ends 22 and 24 at a position that approximately corresponds to a portion of handles 14 that is gripped by the user, wherein middle bridge 50 prevents platform 80 from sliding beyond the user's hand during use of the exercise machine 10. Thus, middle bridge 50 may be adjustably moved and positioned within channel 26 to accommodate a user's preferred gripping position or location on handles 14. In some embodiments, the middle bridge 50 may be coupled to a middle portion of a particular track 20.

In some embodiments, the middle bridge 50 may be coupled between the handle 14 and the end bridge 60 of a particular unit 12 at a fixed location. In some embodiments, the middle bridge 50 may be slidably adjusted and temporary fixed at a desired location within the channel 26. In some embodiments, the middle bridge 50 may be removed and/or the platform 80 may be prevented from sliding beyond the handles 14 by a length and/or tensioning properties of the tensioning elements 110. In some embodiments, the middle bridge 50 may be aligned with a portion of the handle 14 closest to the first end 22. In some embodiments, a position of the middle bridge 50 may be non-adjustable. In other embodiments, units 12 do not include a middle bridge.

In some embodiments, the middle bridge 50 may include any material or combination of materials that are suitable for use in an exercise machine. In some embodiments, the middle bridge 50 may include a rigid material that is capable of withstanding pulling and/or torsional forces during use of the machine. Platform 80 is generally configured to slide along the channel 26 of the track 20 of a particular unit 10 between the end bridge 60 and the middle bridge 50 of the particular unit 10. In some embodiments, the end bridge 60 may be configured to be selectively secured to the track, such as within the channel 26 of the track 20 of the particular unit 10, at a location between the end cap 40 and the middle bridge 50 of the particular unit 10.

In some instances, the platform 80 and the knee adapter 78 may include a single integrated unit. In other embodiments, the knee adapter 78 may be secured to the platform 80 via one or more fasteners. In some embodiments, the platform 80 may include one or more notches 84 (illustrated in FIG. 2), which may be configured to selectively receive a distal end of one or more of the tensioning elements 110. In some embodiments, the notches 84 may be disposed on a distal edge 88 of the platform 80. In some embodiments, the notches 84 are aligned with the notches 62 of the end bridge 60, wherein the notches 62 may be configured to selectively receive a proximal end of one or more of the tensioning elements 110.

In some embodiments, the tensioning elements 110 may be coupled between the platform 80 and the end bridge 60 via the notches 62 and the notches 84. For example, the tensioning elements 110 may include an elastic cord or elastomeric band having enlarged distal and proximal ends 112 (illustrated in FIGS. 1B and 2) that are retained by the notches 62 and the notches 84. In some embodiments, the user may vary the tension between the platform 80 and the end bridge 60 by: 1) adjusting a number of tensioning elements 110 interconnecting the platform 80 and the end bridge 60, 2) selecting tensioning elements 110 having greater or lesser tensioning properties, or 3) adjusting the number of tensioning elements 110 and selecting tensioning elements 110 having greater of lesser tensioning properties. In some embodiments, the tensioning properties of the tensioning elements 110 provide gradual and progressive resistance between the platform 80 and the end bridge 60 as the distance between the platform 80 and the end bridge 60 increases. Thus, the exercise machine 10 may provide resistance to the user. The various notches of the present disclosure may be configured to receive a single tensioning element 110 or may be configured to receive multiple tensioning elements 110. In one embodiment, each of the units 12 is configured to receive up to three tensioning elements 110.

In some embodiments, exercise device 10 may include tensioning elements comprising a weight stack operably connected to the platform 80 by one or more cables (or an equivalent element, such as a static band) and pulleys, such that the resistance of the platform 80 may be adjusted by selecting a desired amount of weight from the weight stack (see, for example, the pulley, cable and weight stack arrangement disclosed in U.S. Pat. No. 9,486,668, which is incorporated herein by reference in its entirety). In some embodiments, tensioning elements may comprise hydraulic resistance. In some embodiments, tensioning elements may comprise electromagnetic resistance.

In some embodiments, the platform 80 may overlap the sidewall 30 and extend over the lip 32, as illustrated in FIG. 1, which may facilitate maintenance of proper placement and alignment of the platform 80 when the platform 80 slides within the channel 26. In some embodiments, the platform 80 may overlap sidewall 30 to prevent injury to the user or the machine 10 due to interference with the sliding relationship between the platform 80 and the track 20.

In some instances, the platform 80 may include a friction-reducing material or device 100 to facilitate sliding of the platform within the channel 26. Generally, the device 100 reduces or eliminates friction between the platforms 80 and the channel 26, thereby providing a smooth sliding motion for the platform 80. In some embodiments, the device 100 may include one or more wheels. In some embodiments, the device 100 may include one or more bearings. In some embodiments, the device 100 may include a low friction coating or material, such as, for example, polytetrafluoroethylene.

In some embodiments, the first unit 12*a* and/or the second unit 12*b* may include a measurement device 21. In some embodiments, the measurement device 21 may be configured to count a number of times the platform 80 of a particular unit 12 moves away and/or toward the end bridge 60 of the particular unit 12 in a predetermined time period. In some embodiments, the measurement device may be configured to count a time it takes for the platform 80 to move away and/or toward the end bridge 60 a predetermined number of times.

In some embodiments, the measurement device 21 may include any number of sensors. For example, the measurement device may include a light, pressure, and/or motion sensor which may detect movement of the platform 80. In some embodiments, the measurement device 21 may include a timer. In some embodiments, the measurement device 21 may be positioned on the exercise machine 10 so as to be visible to the user operating the exercise machine 10. In some embodiments, the measurement device 21 may be wirelessly connected to a mobile device, such as through a Bluetooth® or WiFi® connection. In some embodiments, the measurement device 21 is used in conjunction with a mobile app.

With continued reference to FIG. 2, in some embodiments, each of one or more tensioning elements 110 may include an elastomeric band, which may include proximal and distal (terminal) ends that are wider than notches 62 and 84 and a middle section narrower than notches 62 and 84. As such, in some embodiments, the middle section of the tensioning elements 110 may be seated into notches 62 and 84 with the terminal ends being positioned outside of the notches. In some embodiments, tension between the platform 80 and the end bridge 60 gradually increases as the platform 80 is slid towards an opposite end of the track 20 and/or the middle bridge 50. As discussed previously, the tensioning elements 110 may be constructed of any material or structure that is suitable for use in the exercise machine 10. The knee adapter 78 is removed in FIG. 2 for illustrative purposes to more clearly show the tensioning elements 110. In some embodiments, the tensioning elements 110 may bias the platform 80 towards and/or against the end bridge 60.

The exercise machine 10 may use various systems or devices to retain a position of the end bridges 60 within the channel 26. For example, referring now to FIG. 3, each of the tracks 20 may include one or more holes or detents 120 that are configured to receive a pin or set screw of the corresponding end bridge 60, thereby retaining a position of the end bridge 60 within the channel 26. In some embodiments, a fixed position of the end bridge 60 may be slidably adjusted within the track 20 of a particular unit 10 along the lip 32 to increase and decrease a distance between the end bridge 60 and the handle 14 of the particular unit 10.

The exercise machine 10 may also use various systems or devices to retain a position of the handles 14 with respect to the first and second units 12*a*, 12*b*. For example, each of the tracks 20 may include one or more receptacles or holes 34, which may be configured to selectively receive a pin of an extension 36 of a particular handle 14 to provide a fixed position for the particular handle 14, as explained in further detail with respect to FIG. 5. Although illustrated toward the second end 24 of the track 20, the one or more other holes 34 may be disposed towards a middle of the track 20 and may selectively receive a pin of another extension of the particular handle 14. In some embodiments, the handles 14 of the units 12 may be aligned with each other.

Figure 3:
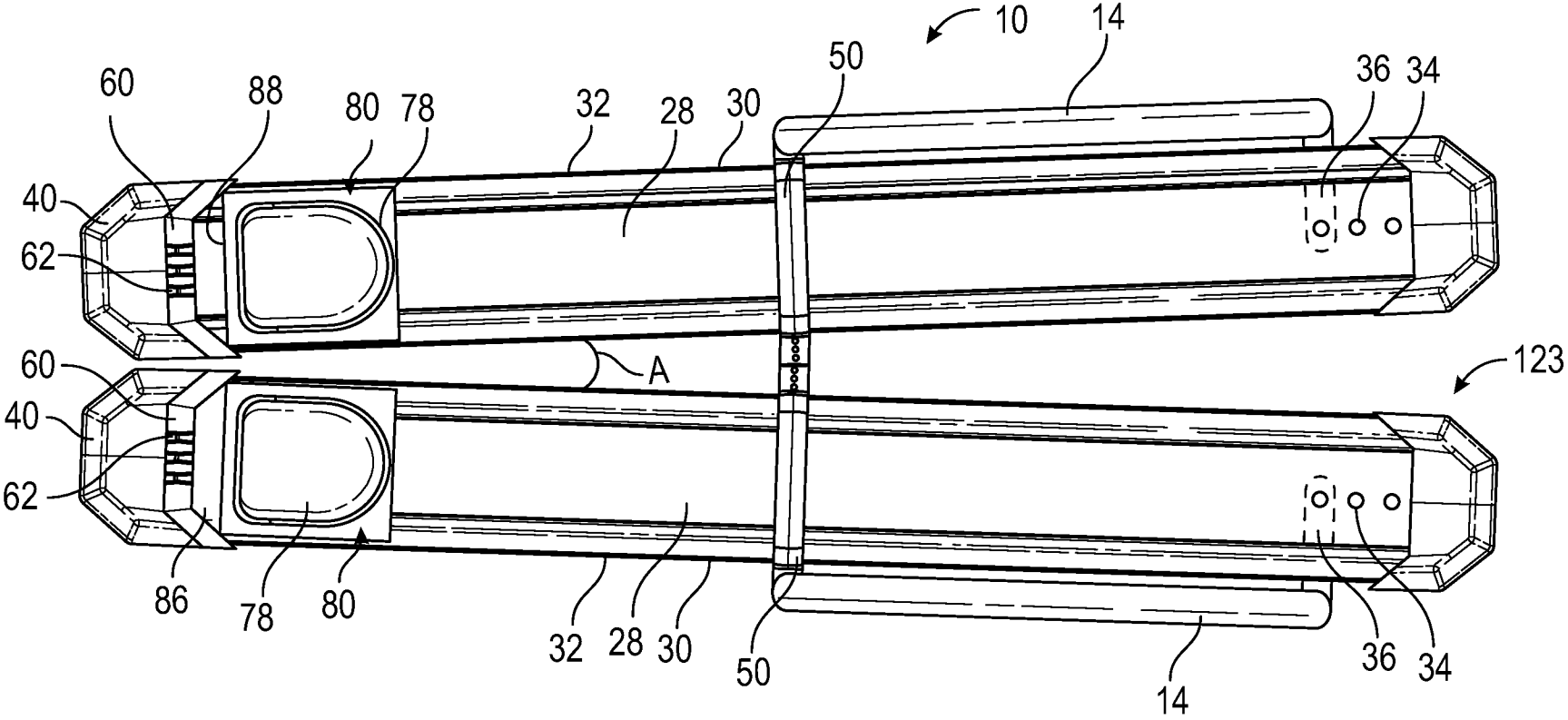
FIG. 3 is a top view of the exercise machine of FIG. 1, according to some embodiments.

As illustrated in FIG. 3, in some embodiments, the first unit 12*a* may be coupled to the second unit 12*b*. The first unit 12*a* may be coupled to the second unit 12*b* at one or at various locations. In some embodiments, the first unit 12*a* may be adjustably coupled to the second unit 12*b*. In further detail, in some embodiments, the first unit 12*a* may be adjustably coupled to the second unit 12*b* such that a distance between the first unit 12*a* and the second unit 12*b* is adjustable. Additionally or alternatively, in some embodiments, the first unit 12*a* may be adjustably coupled to the second unit 12*b* such that an angle A between the first and second units 12*a*, 12*b* is adjustable. In some embodiments, the angle A may be between 0 and 30 degrees. In some embodiments, the first handle 12*a* may be adjustably coupled to the second handle 12*b* between the first and second tracks, as illustrated in FIG. 3. The first handle 12*a* may be adjustably coupled to the second handle 12*b* via any suitable mechanism, such as, for example, a pin mechanism, as illustrated in FIG. 3. The tensioning elements 110 are not illustrated in FIG. 3.

Figure 4:
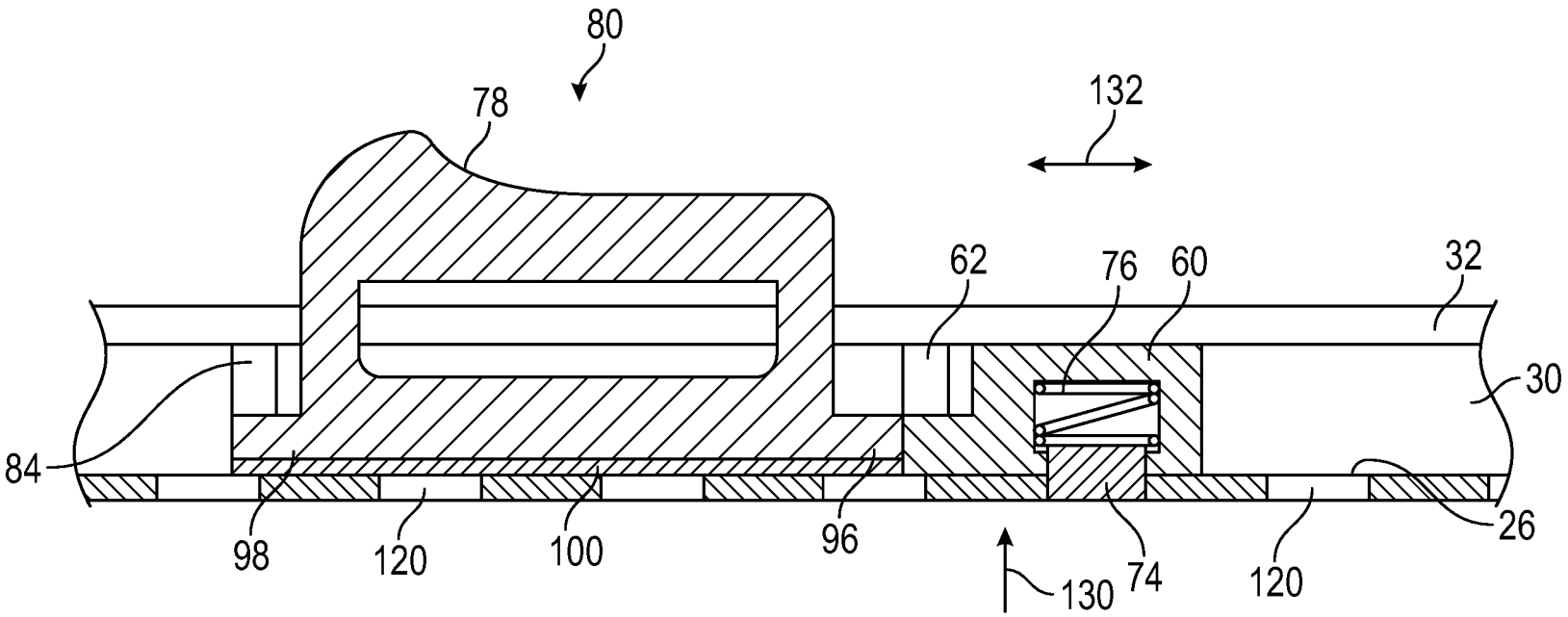
FIG. 4 is a cross-sectional view of a platform and end bridge adjustably coupled to an example track, according to some embodiments.

Referring now to FIG. 4, in some embodiments, the end bridge 60 includes a spring loaded pin or button 74, which may be disposed on a bottom surface of the end bridge 60 and may extend downwardly beyond the bottom surface of the end bridge 60. In some embodiments, the button 74 may be biased outwardly by a spring 76 such that the button 74 remains engaged with the hole or detent 120. Once engaged, movement of the end bridge 60 relative to the track 20 may be prevented. In some embodiments, the end bridge 60 may be moved by depressing 130 button 74 while simultaneously sliding 132 end bridge 60 within the channel 26 to a desired location. In some embodiments, the button 74 may be again biased into a new hole 120 when proper alignment between button 74 and the hole 120 is achieved.

Referring now to FIGS. 5A-5E, an embodiment of exercise machine 10 is shown comprising an elevated platform 31 coupled to first and second units 12 via a stand 33, wherein elevated platform 31 comprises a surface 35 for receiving and supporting a user's elbows and/or forearms while using the exercising machine.

In some embodiments, stand 33 is directly coupled to at least one of first and second units 12. In some embodiments, stand 33 is indirectly coupled to first and second units 12 via a base 220, wherein base 220 is configured to support first and second units 12 along a length of first and second units 12. In some embodiments, stand 33 is an extension of base 220, wherein it may be understood that elevated platform 31 is coupled to the stand 33 portion of base 220. In some embodiments, first and second units 12 are fixedly coupled to base 220. In some embodiments, first and second units 12 are adjustably coupled to base 220, such that the positions of first and second units 12 may be adjusted relative to one another, relative to base 220. In some embodiments, first and second units 12 may be adjusted and positioned relative to one another at an angle A, such that a distance between the proximal or first ends of first and second units 12 is small than a distance between the distal or second ends of first and second units 12.

In some embodiments, surface 35 of elevated platform 31 comprises one or more pads or cushions 37 configured to accommodate and support a user's forearms while using exercise machine 10. In some instances, cushions 37 comprise a generally horizontal portion configured to support the user's forearm, and a generally vertical portion configured to hold the user's elbow and a portion of the user's lower triceps. This generally vertical portion may further prevent the user's elbow and forearm from sliding in a proximal direction 41 during use of the exercise machine. Accordingly, in some embodiments the generally vertical portion may provide leverage to the user when using the exercise machine.

In some embodiments, surface 35 is generally planar and parallel to a surface on which the exercise machine is supported. In some embodiments, surface 35 is angled in proximal direction 41. In some embodiments, a portion of surface 35 corresponding to pads or cushions 37 is angled inwardly towards a longitudinal center axis of the exercise machine 10, such that the angle accommodates a physical attribute of the user. In some embodiments, this angle is fixedly set. In some embodiments, this angle may be adjusted by the user.

Figure 5A:
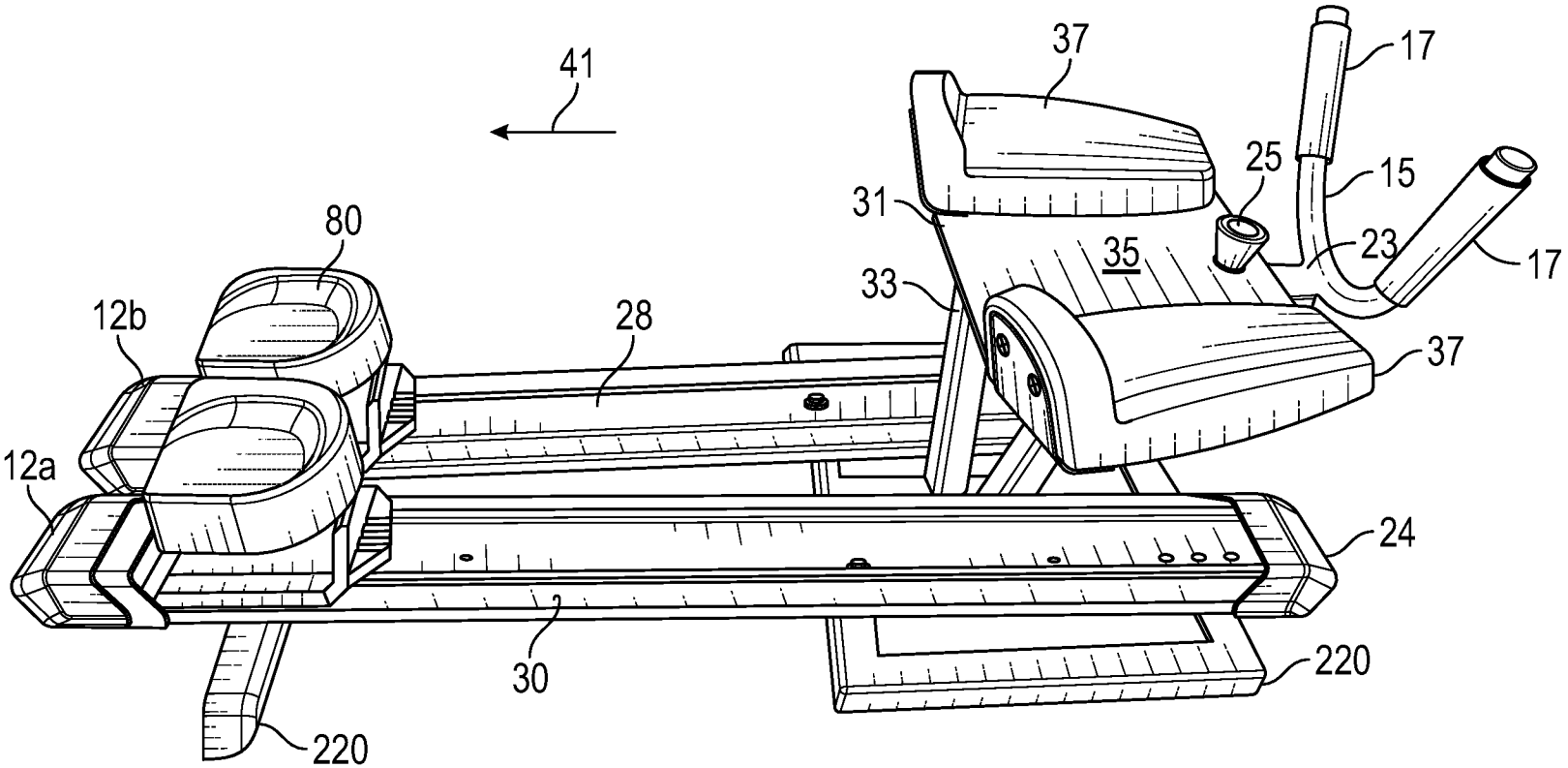
FIG. 5A is a perspective side view of an exercise machine having a raised platform with forearm supports, according to some embodiments.
Figure 5B:
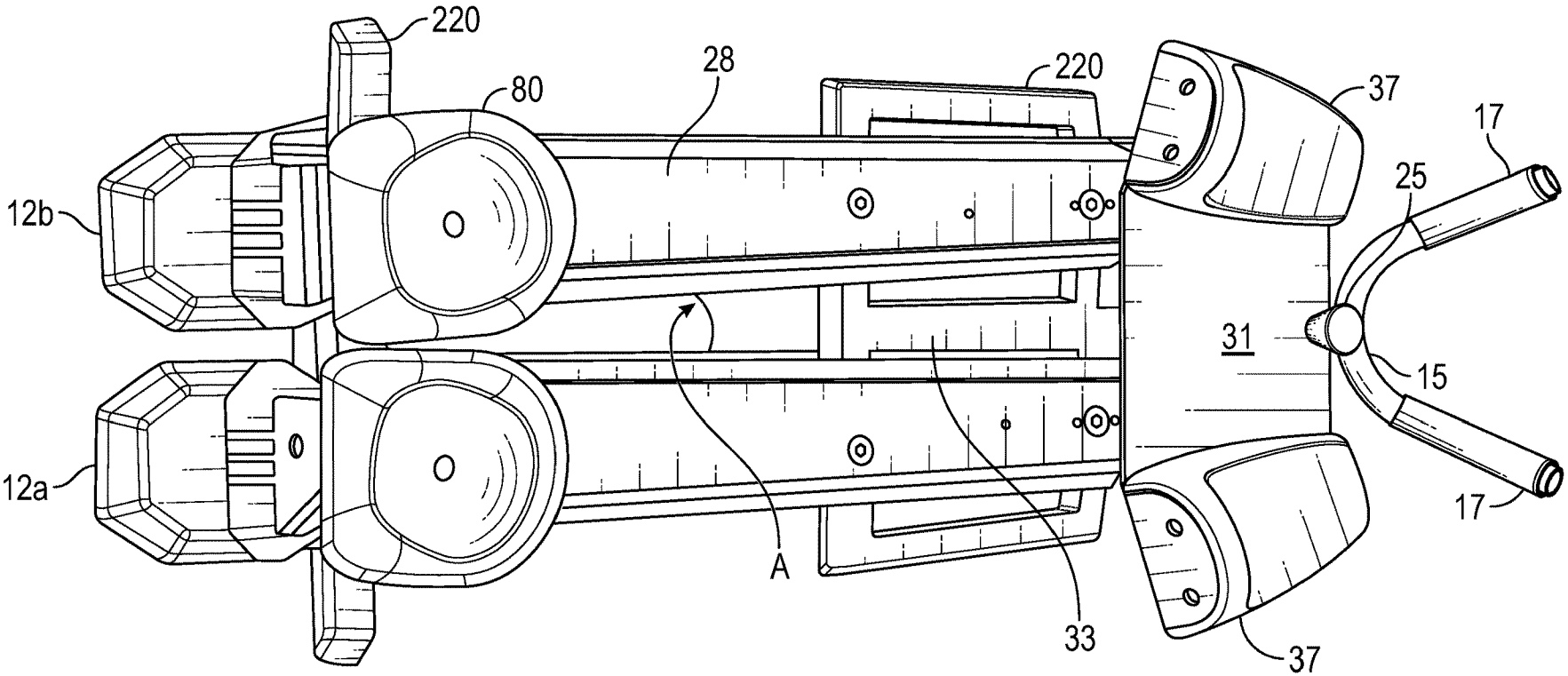
FIG. 5B is a perspective top view of the exercise machine of FIG. 5A, according to some embodiments.
Figure 5C:
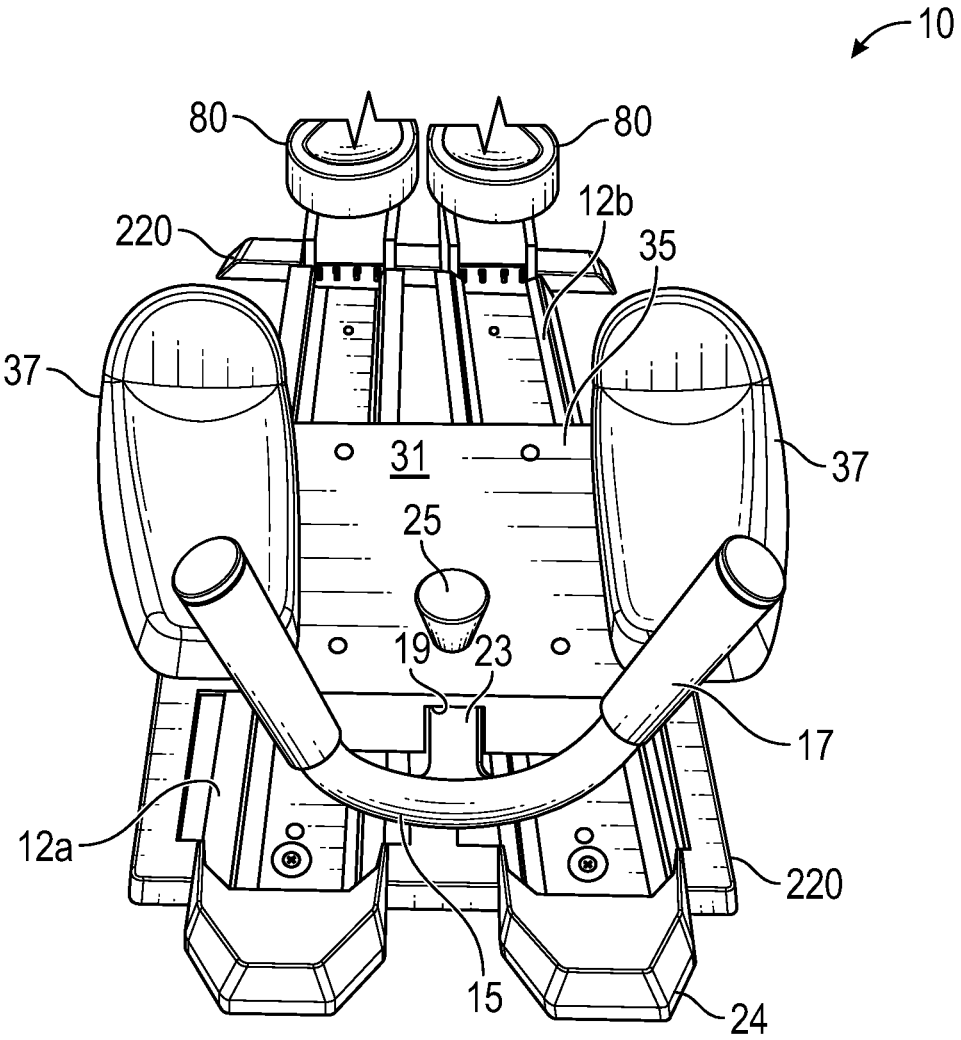
FIG. 5C is a perspective front view of the exercise machine of FIG. 5A, according to some embodiments.
Figure 5D:
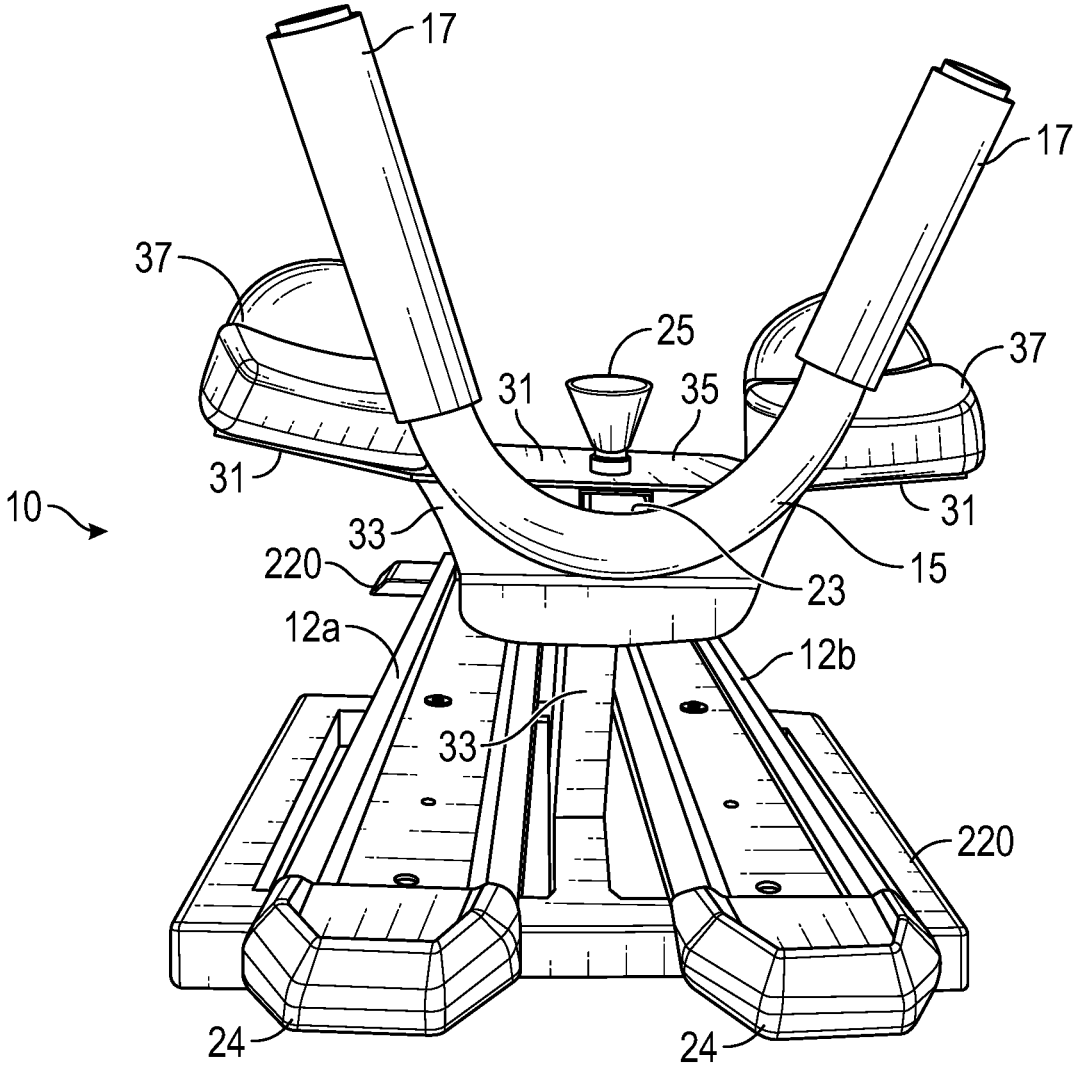
FIG. 5D is a front view of the exercise machine of FIG. 5A, according to some embodiments.
Figure 5E:
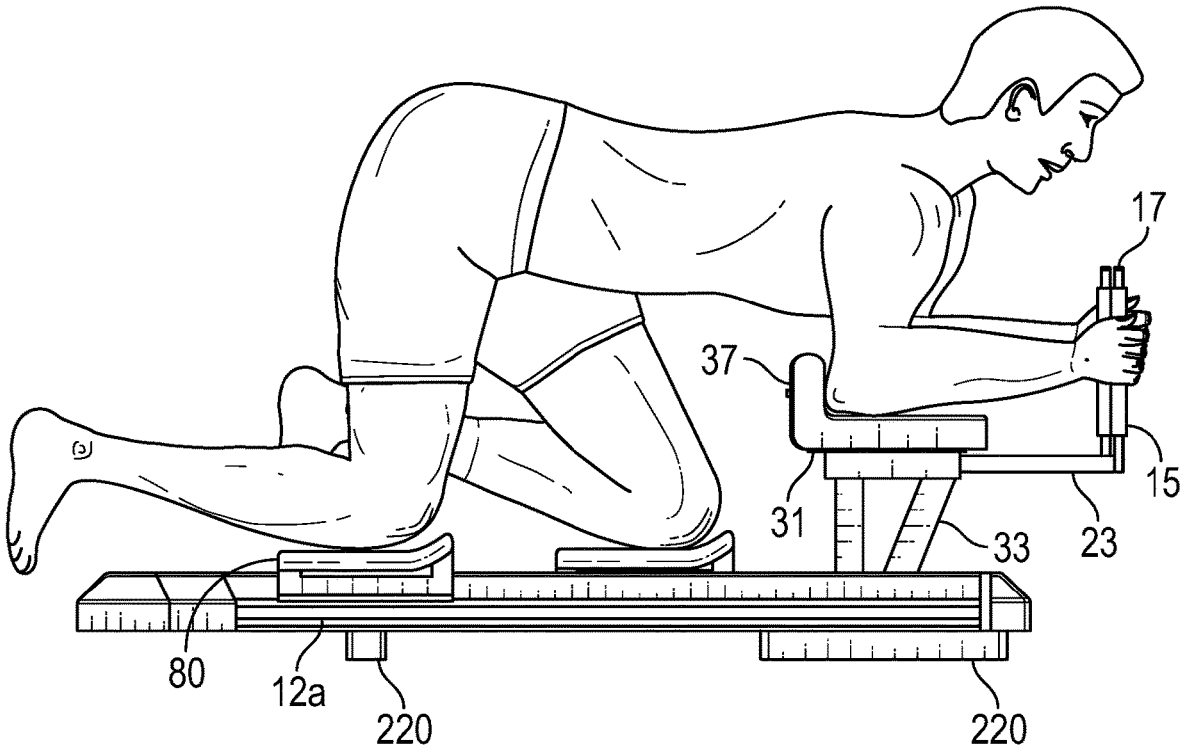
FIG. 5E is a side view of the exercise machine of FIG. 5A being operated by a user, according to some embodiments.

In some embodiments, elevated platform 31 further comprises a handle 15. In some embodiments, handle 15 is directly coupled to elevated platform 31. In some embodiments, handle 15 is indirectly coupled to elevated platform 31 via stand 33. In some embodiments, an extension 23 of handle 15 is slidably housed within a sleeve or receptacle 19 provided in at least one of elevated platform 31 and stand 33. In some embodiments, the position of handle 15 is adjusted distally and proximally as extension 23 is repositioned within receptacle 19. In some embodiments, a desired position of handle 15 is maintained by a mechanical interference, such as by a spring-loaded pin 25, or a set screw configured to intersect the extension 23 and the elevated platform 31 and/or the stand 33. Generally, handle 15 is positioned distal to surface 35 such that grips 17 of handle 15 are positioned forward of elevated platform 31. In some embodiments, handle 15 is capable of being positioned such that a distance between grips 17 and the vertical portion of cushions 37 is approximately equal to the length of a user's forearm, as shown in FIG. 5E. In some embodiments, the height of elevated platform 31 is set at a fixed height. In some embodiments, the height of elevated platform 31 is adjustable.

The present invention further comprises a method for increasing an efficiency and safety of muscle development using the exercise device 10 shown in FIGS. 5A-5E. In some embodiments, the method may include a first step of adjusting a position of the handles 15 to accommodate a user's torso and arm lengths. This step sets the machine to provide an optimal starting position for the user. In some embodiments, an optimal starting position is achieved when a user's knees are resting on the knee adapters 80, the user's forearms are resting on the cushions 37, and the user's hands are gripping the grips 17, wherein the user's triceps are approximately parallel to the user's thighs while in a prone position on the machine. In some instances, a user may be required to set the position of the handles 15 to increase or decrease a distance between the handles 15 and the knee adapters 80.

At a second step, the user may then grasp the handles of the exercise machine while in a prone position and place his or her knees in the knee adapters. This may be referred to as the optimal starting position. The user uses exercise machine 10 by alternating forward and backward movements of their knees along the tracks, such that the knee cups move in a running motion, wherein the user maintains a prone position. In further detail, the user engages in a motion similar to running, alternating between pulling their left leg toward the core of their body, and pulling their right leg toward the core of their body. As the left leg is pulled toward the core, one or more first abdominal muscles may contract, and as the right leg is pulled toward the core, one or more second abdominal muscles opposite the first abdominal muscles may contract. Thus, the abdominal muscles of the user may be alternately strengthened.

As the user pulls the left leg towards the core, the user may simultaneously flex left arm muscles. Similarly, as the user pulls the right leg toward the core, the user may simultaneously flex right arm muscles. Thus, the exercise machine may facilitate rotation of shoulders of the user as in running, which may also strengthen the abdominal and other core muscles of the user. In some embodiments, the user may simultaneously move both knees in the knee adapters forward and backward while contracting their abdominal muscles, as opposing to engaging in a running motion.

Figure 6:
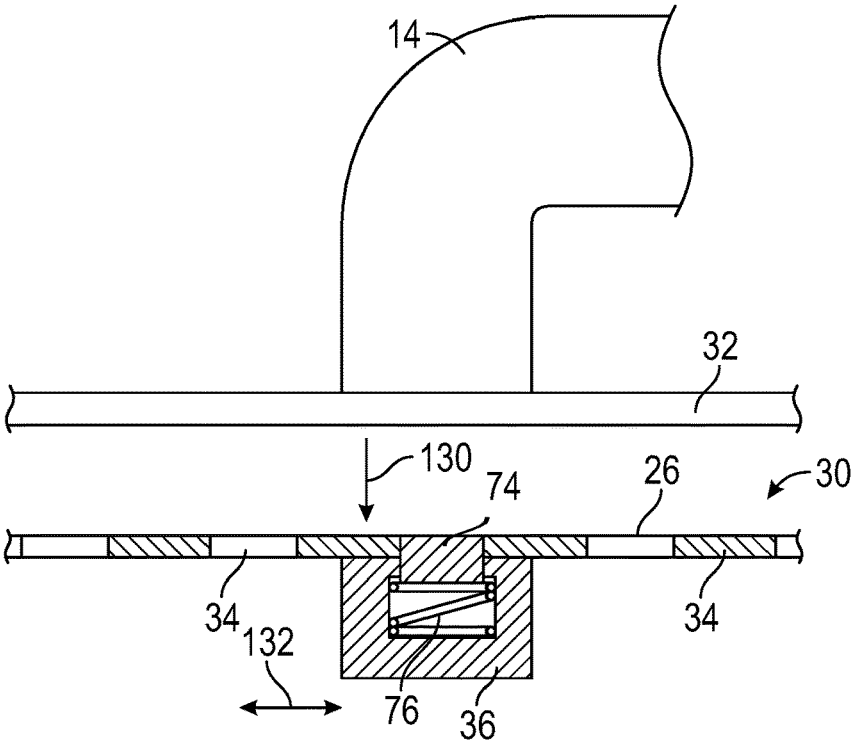
FIG. 6 is a cross-sectional view of a portion of an example handle adjustably coupled to an example track, according to some embodiments.

Referring now to FIG. 6, the exercise machine 10 may use various systems or devices to retain a position of the handles 14 with respect to the tracks 20. For example, each of the tracks 20 may include one or more detents or other holes 34 that are configured to receive a pin or set screw of the extension 36 of a particular handle 14, thereby retaining a position of the extension 36. In some embodiments, the extension 60 includes a spring loaded pin or button 74, which may be disposed on an upper surface of the extension and may extend upwardly beyond the upper surface of the extension 36. In some embodiments, the button 74 may be biased outwardly by spring 76 such that the button 74 remains engaged within a particular other hole 34. Once engaged, movement of extension 36 and corresponding handle 14 relative to the track 20 may be prevented. In some embodiments, the extension 36 may be moved by depressing 130 button 74 while simultaneously sliding 132 extension 36 within the channel 26 to a desired location. In some embodiments, the button 74 may be again biased into a new other hole 34 when proper alignment between button 74 and the new other hole 34 is achieved. Although illustrated toward the middle portion of the track 20, the extension 36 may be disposed towards the second end 24 of the track 20 towards another portion of the handle 14. In some embodiments, handles 14 may be permanently coupled to tracks 20, such by welding, an adhesive, an epoxy, and/or a mechanical fastener, such as a screw, or bolt and nut.

Figure 7:
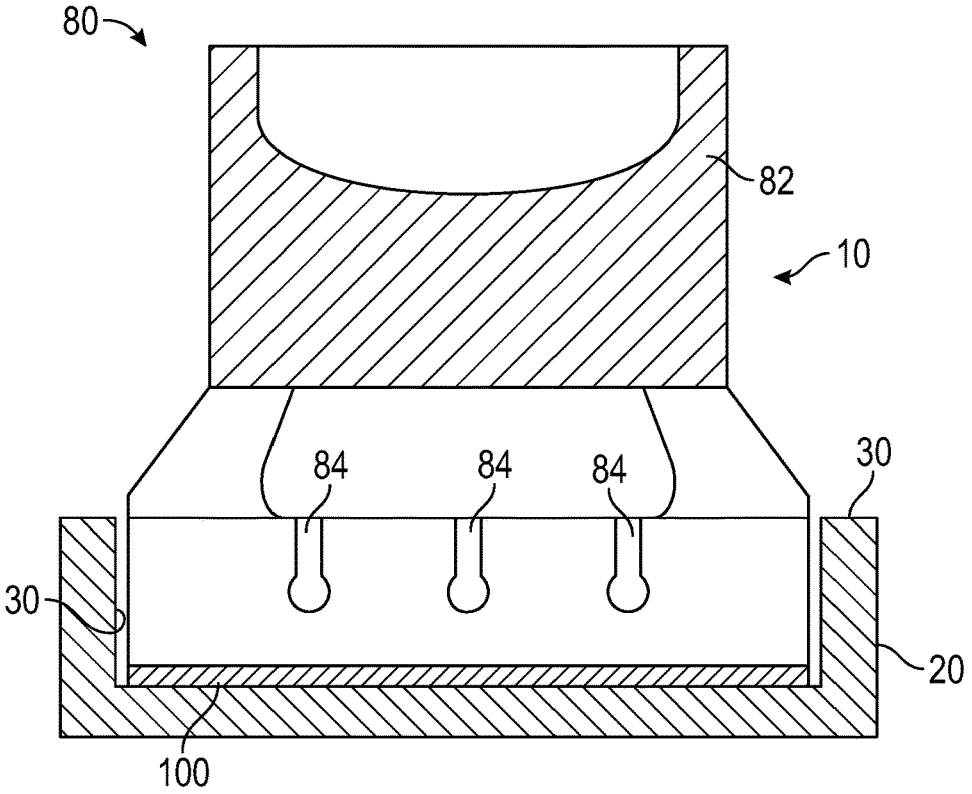
FIG. 7 is a cross-sectional view of an example platform, according to some embodiments.

Referring now to FIG. 7, in some embodiments, the platform 80 may be removably and/or rotatably seated into the channel 26. In some embodiments, the channel 26 may be configured with straight sidewalls 30 and without a lip, thereby permitting the platform 80 to be dropped into and lifted out of the channel 26, as desired. In some embodiments, the platform 80 similarly comprises straight sidewalls and an overall width that is slightly less than the inner diameter of the channel 26. In some embodiments, the platform 80 further comprises a friction reducing material 100 that is interposedly positioned between the platform 80 and the channel 26. In some embodiments, additional friction reducing material is applied to at least one of the sidewall 30, and the sidewall of platform 80. Friction reducing materials may include any material or combination of materials having properties that reduce friction between platform 80 and channel 26. Non-limiting examples of suitable friction reducing materials include PTFE (polytetrafluoroethylene), bearing and wear materials made of polyimide, PEEK, PPS, Nylon, Acetal and Polyester, ball bearings, needle bearings, spherical roller bearings, cylindrical roller bearings, tapered roller bearings, and various lubricants, including but not limited to oils and greases comprising hydrogenated polyolefins, esters, silicones, fluorocarbons, and other suitable base oils. As such, in some embodiments, the platform 80 is configured to slide within channel 26 between the end cap 40 and the handles 14 and/or the middle bridge 50. In some embodiments, the platform 80 is further configured to rotate freely within the channel 26.

Figure 8A:
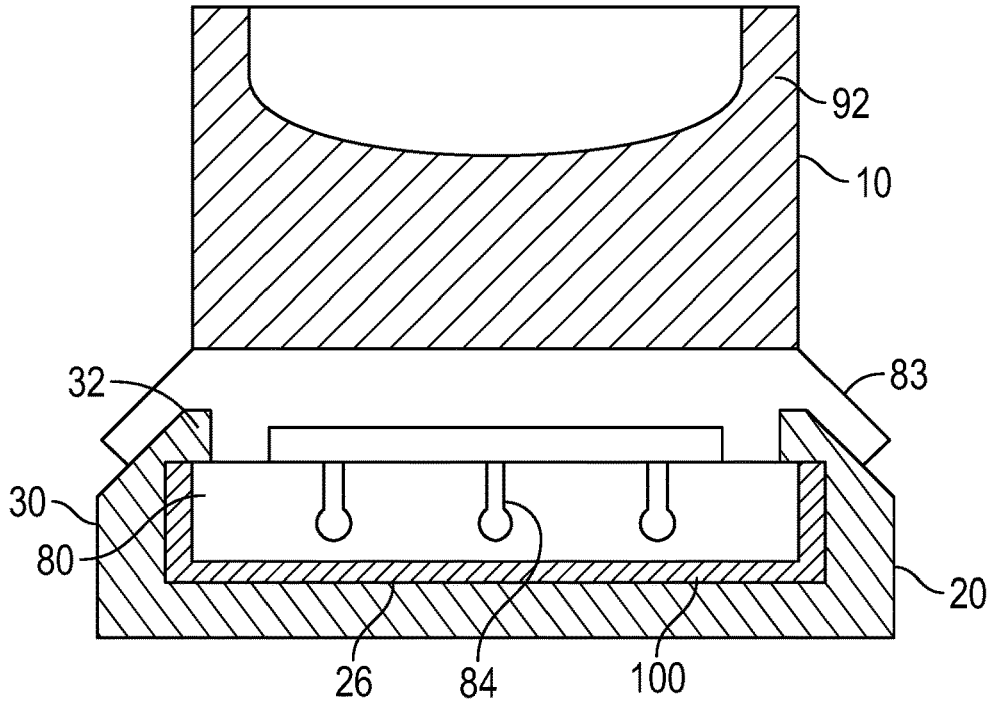
FIG. 8A-8C are cross-sectional views cut across widths of other example exercise machines, according to some embodiments.
Figure 8B:
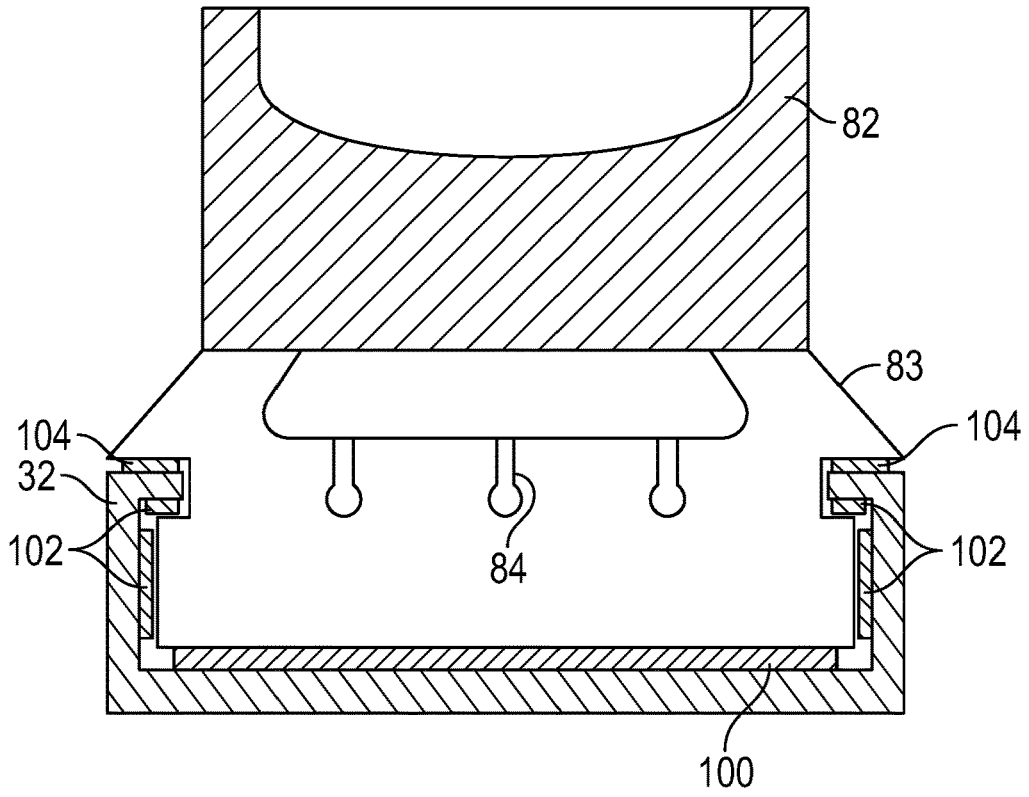
Figure 8C:
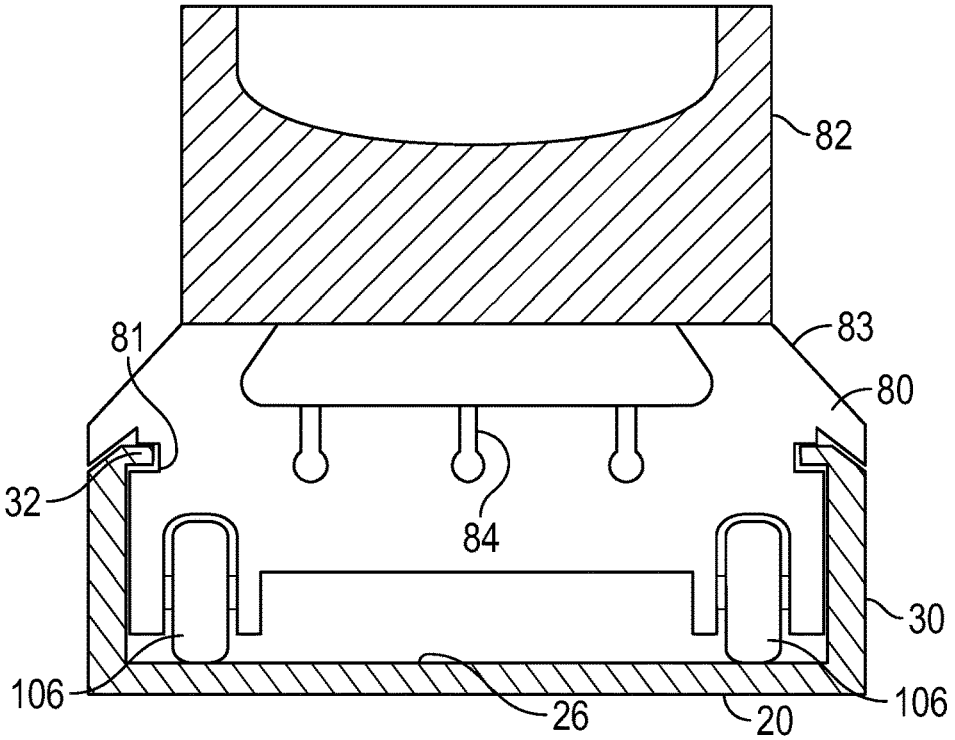

Referring now to FIGS. 8A-8C, various configurations of the platforms 80 and each of the tracks 20 are provided. In some embodiments, the exercise machines illustrated in FIGS. 8A-8C may include or correspond to the exercise machine 10. In some embodiments, each of the tracks 20 includes a lip 32 that extends inwardly into the channel 26 and interconnects with the platform 80 and/or the knee cap 78. In some embodiments, the intersection between the platform 80 and the track 20 further comprises an interaction between extension 83 and an outer surface of the lip 32. In these embodiments, removal of the platform 80 from track 20 may not be possible unless the end cap 40 and the end bridge 60 are removed from track 20, thereby opening an end of track 20.

In some embodiments, the channel 26 and the inner surface of sidewall 30 further comprises a friction reducing device, material, and/or coating 100. In some embodiments, the material 100 provides a low-friction barrier between platform 80 and channel 26, thereby providing smooth movement of platform 80 therein. Additionally or alternatively, in some embodiments, the material 100 may be applied to the undersurface and perimeter sidewall surfaces of platform 80. As such, the material 100 is interposedly positioned between platform 80 and channel 26.

Further still, in some embodiments, the material 100 may include a first material and may be applied to the undersurface of the platform 80, and a second material 102 may be applied to the channel 26, as shown in FIG. 7B. In some embodiments, a third material 104 may be applied to the outer surface of the lip 32 so as to be interposed between the lip 32 and the extension 83 of the platform 80. One having skill in the art will appreciate that the material 100 may be applied to any number of surfaces to reduce friction between the platform 80 and the track 20, as disclosed herein.

With reference to FIG. 8C, in some embodiments, the platform 80 may include a friction reducing device comprising a set of wheels 106. In some embodiments, the wheels 106 may be configured to reduce friction between platform 80 and channel 26. In some embodiments, the platform 80 may include a retention groove 81 into which at least a portion of the lip 32 is inserted. In some embodiments, the retention groove 81 prevents platform 80 from being removed from channel 26. In some embodiments, one or more of the following: the platform 80, channel 26, lip 32, and the retention groove 81, may additionally include one or more friction reducing devices or materials within the spirit of the present disclosure.

Figure 9:
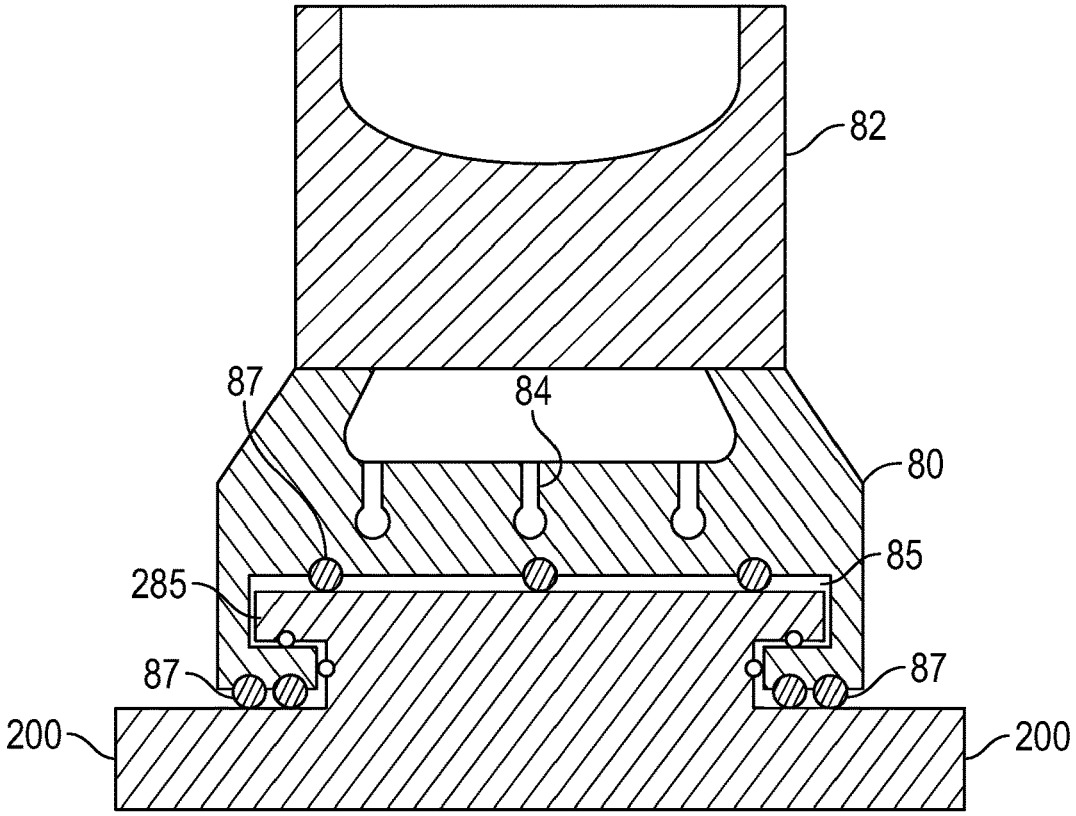
FIG. 9 is a cross-sectional cut across a width of another example exercise machine, according to some embodiments.

Referring now to FIG. 9, in some embodiments, track 20 of the exercise machine 10 may include a rail 200. In some embodiments, the exercise machine illustrated in FIGS. 7 and 8 may include or correspond to the exercise machine 10. Thus, in some embodiments, the platform 80 may include a C-shaped channel 85 that may be configured to compatibly receive a T-shaped extension 285 of rail 200. In some embodiments, the channel 85 may further comprise a friction reducing device and/or material to reduce friction between the platform 80 and the rail 200. For example, in some embodiments the channel 85 may include multiple ball bearings 87. In other instances, the extension 285 may include a friction reducing material and/or coating. In some embodiments, the rail 200 may include a base 220 having an extended width configured to increase a stability of the exercise machine 10.

Figure 10:
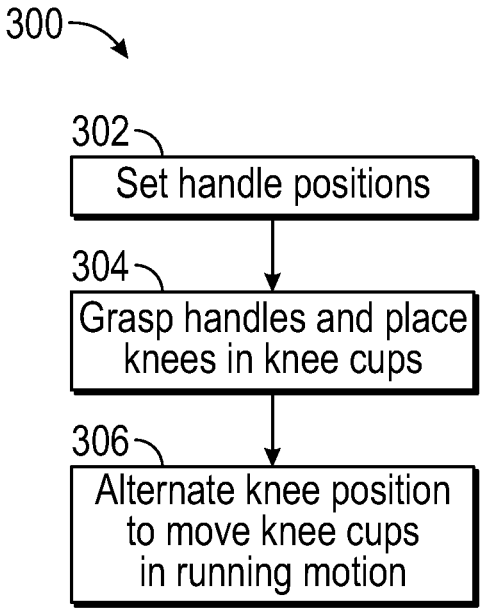
FIG. 10 is a flowchart providing an example method for using the exercise machine of FIG. 1, according to some embodiments.

Referring now to FIG. 10, a method 300 for increasing an efficiency and safety of muscle development is illustrated. The method 300 may be followed when using the exercise machine 10. Alternatively, the method 300 may be provided as instruction when teaching a user how to properly use the exercise device 10.

In some embodiments, the method 300 may include a first step 302 of adjusting a position of the handles to accommodate a user's torso length. This step sets the machine to provide an optimal starting position for the user. In some embodiments, an optimal starting position is achieved when a user's knees are resting on the knee adapters 82, the user's hands are gripping the handles 14, and the user's arms are approximately parallel to the user's thighs while in a prone position on the machine. In some instances, a user may be required to set the position of the handles 14 to increase or decrease a distance between the handles 14 and the knee adapters 82.

At a second step 304, the user may then grasp the handles of the exercise machine while in a prone position and place his or her knees in the knee adapters. This may be referred to as the optimal starting position. At step 305, the user may alternate or move their knees back and forth along the tracks to move the knee cups in a running motion, wherein the user maintains a prone position. In further detail, the user may then engage in a motion similar to running, alternating between pulling a left leg toward a core of a body of the user, and pulling a right leg toward a core of the body of the user. As the left leg is pulled toward the core, one or more first abdominal muscles may contract, and as the right leg is pulled toward the core, one or more second abdominal muscles opposite the first abdominal muscles may contract. Thus, the abdominal muscles of the user may be alternately strengthened.

Figure 11:
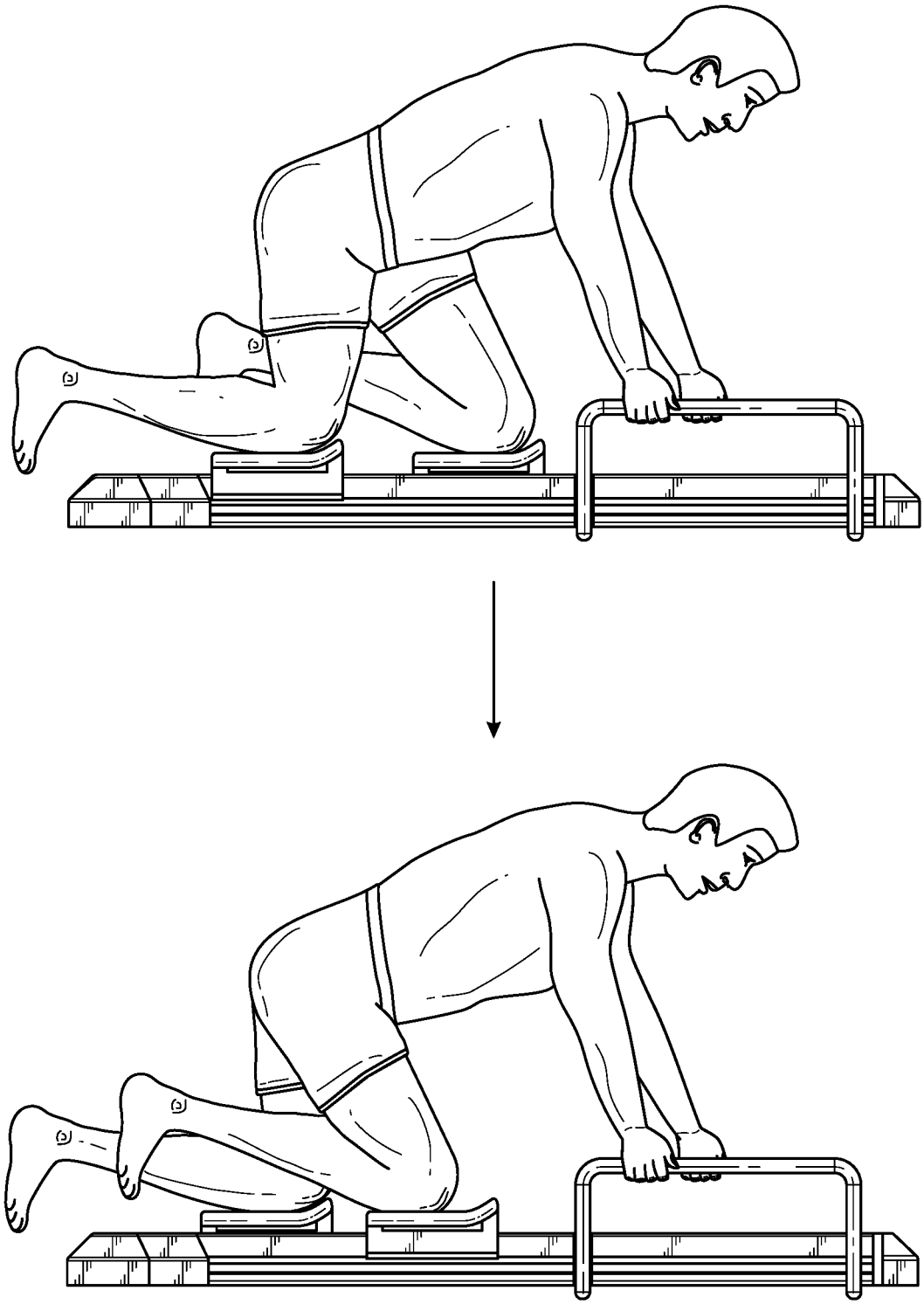
FIG. 11 is a side view of the exercise machine of FIG. 1 being operated by a user, according to some embodiments.

As the user pulls the left leg towards the core, the user may simultaneously flex left arm muscles. Similarly, as the user pulls the right leg toward the core, the user may simultaneously flex right arm muscles. Thus, the exercise machine may facilitate rotation of shoulders of the user as in running, which may also strengthen the abdominal and other core muscles of the user. Step 305 is further illustrated in FIG. 11. In some embodiments, the user may simultaneously move both knees in the knee adapters forward and backward, as opposing to engaging in the motion similar to running.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. An exercise machine, comprising:

a base;

a track coupled to a top surface of the base and comprising a proximal end and a distal end;

a second track coupled to the top surface of the base and comprising a proximal end and a distal end;

a platform coupled to the track and having a knee support, said platform configured to slide between the proximal end of the track and the distal end of the track;

a tensioning element configured to provide resistance as the platform slides from the proximal end of the track to the distal end of the track; and a stand coupled to the base in proximity to the distal end of the track and comprising an elevated platform, wherein the track is positioned between the base and the elevated platform, wherein the elevated platform comprises an elbow support and a handle in proximity to the elbow support, wherein the track and the second track are angled with respect to each other such that a distance between the proximal end of the track and the proximal end of the second track is greater than a distance between the distal end of the track and the distal end of the second track.

2. The exercise machine of claim 1, wherein the tensioning element is configured to provide progressive resistance as a distance between the platform and the proximal end of the track increases.

3. The exercise machine of claim 1, wherein the platform further comprises a set of wheels configured to contact a channel formed in the track.

4. The exercise machine of claim 1, wherein the track further comprises:

an end bridge; and a plurality of holes configured to selectively receive a pin of the end bridge to provide a fixed position for the end bridge on the track.

5. The exercise machine of claim 4, wherein the fixed position of the end bridge is configured to be slidably adjusted to increase and decrease a distance between the end bridge and the proximal end of the track.

6. The exercise machine of claim 4, wherein the track further comprises a middle bridge coupled to a middle portion of the track, wherein the platform is configured to slide along at least a portion of the track between the end bridge and the middle bridge.

7. The exercise machine of claim 1, wherein the track is configured to be selectively inclined with respect to a horizontal axis.

8. The exercise machine of claim 1, further comprising a measurement device, wherein the measurement device is configured to count a number of times the platform moves away from the proximal end of the track in a time period.

9. An exercise machine, comprising:

a base;

a track coupled to a top surface of the base and comprising a proximal end and a distal end, the track further comprising an end bridge, and a plurality of holes configured to selectively receive a pin of the end bridge to provide a fixed position for the end bridge on the track;

a platform coupled to the track and having a knee support, said platform configured to slide between the proximal end and the distal end of the track;

a tensioning element configured to provide resistance as the platform slides from the proximal end to the distal end; and a stand coupled to the base in proximity to the distal end of the track and comprising an elevated platform, wherein the track is positioned between the base and the elevated platform, wherein the elevated platform comprises an elbow support and a handle in proximity to the elbow support.

10. The exercise machine of claim 9, wherein the fixed position of the end bridge is configured to be slidably adjusted to increase and decrease a distance between the end bridge and the proximal end.

11. The exercise machine of claim 9, wherein the track further comprises a middle bridge coupled to a middle portion of the track, wherein the platform is configured to slide along at least a portion of the track between the end bridge and the middle bridge.

12. The exercise machine of claim 9, wherein the track is configured to be selectively inclined with respect to a horizontal axis.

13. The exercise machine of claim 9, further comprising a measurement device, wherein the measurement device is configured to count a number of times the platform moves away from the proximal end in a time period.

14. The exercise machine of claim 9, wherein the tensioning element is configured to provide progressive resistance as a distance between the platform and the proximal end increases.

15. The exercise machine of claim 9, wherein the platform further comprises a set of wheels configured to contact a channel formed in the track.

16. The exercise machine of claim 9, further comprising a second track, wherein the track and the second track are angled with respect to each other such that a distance between the proximal end of the track and a proximal end of the second track is greater than a distance between the distal end of the track and a distal end of the second track.

* * * * *